US005813967A

United States Patent [19]

Davila

[11] Patent Number: 5,813,967

[45] Date of Patent: Sep. 29, 1998

[54] CUSHIONING CONVERSION MACHINE WITH GUIDE ROLLER, AND METHOD

[75] Inventor: Sandra K. Davila, Ashtabula, Ohio

[73] Assignee: Ranpak Corp., Concord Township, Ohio

[21] Appl. No.: 810,126

[22] Filed: Feb. 25, 1997

[51] Int. Cl.[6] ..... B31F 1/00; B65H 45/00; B31D 5/00

[52] U.S. Cl. ..... 493/464

[58] Field of Search ..... 493/352, 459, 493/461, 462, 464, 967

[56] References Cited

U.S. PATENT DOCUMENTS

| | | | |
|---|---|---|---|
| 2,569,589 | 10/1951 | Trissell . | |
| 2,721,709 | 10/1955 | Auerbacher . | |
| 2,860,703 | 11/1958 | O'Donnell . | |
| 3,069,107 | 12/1962 | Hirt . | |
| 3,136,462 | 6/1964 | Knutson . | |
| 3,238,852 | 3/1966 | Schur et al. . | |
| 3,283,874 | 11/1966 | Goreham . | |
| 3,509,797 | 5/1970 | Johnson . | |
| 3,603,216 | 9/1971 | Johnson . | |
| 3,655,500 | 4/1972 | Johnson . | |
| 3,682,696 | 8/1972 | Yasuda . | |
| 3,799,039 | 3/1974 | Johnson | 493/464 |
| 3,880,372 | 4/1975 | Witte . | |
| 3,899,166 | 8/1975 | Behn . | |
| 4,026,198 | 5/1977 | Ottaviano . | |
| 4,059,256 | 11/1977 | Palmer . | |
| 4,109,040 | 8/1978 | Ottaviano . | |
| 4,237,776 | 12/1980 | Ottaviano . | |
| 4,258,846 | 3/1981 | Campo . | |
| 4,557,716 | 12/1985 | Ottaviano . | |
| 4,717,613 | 1/1988 | Ottaviano . | |
| 4,750,896 | 6/1988 | Komaransky | 493/464 |
| 4,839,210 | 6/1989 | Komaransky et al. . | |
| 4,884,999 | 12/1989 | Baldacci . | |
| 4,937,131 | 6/1990 | Baldacci et al. . | |
| 4,968,291 | 11/1990 | Baldacci | 493/464 |
| 5,188,581 | 2/1993 | Baldacci | 493/967 |
| 5,211,620 | 5/1993 | Ratzel | 493/464 |
| 5,387,173 | 2/1995 | Simmons | 493/967 |

*Primary Examiner*—Jack W. Lavinder
*Attorney, Agent, or Firm*—Renner, Otto, Boisselle & Sklar, P.L.L.

[57] ABSTRACT

A cushioning conversion machine which converts a multi-ply sheet stock material into a cushioning product is characterized by an arrangement and methodology that minimizes slack in the inner ply payed off of a stock roll that might lead to the formation, upstream of the conversion components, of a "bag" that negatively impacts the integrity or quality of the cushioning product upon passage through conversion components of the machine. In a preferred embodiment, a guide member is interposed between ply separator members and a forming assembly to bring the outer edges of the plies substantially back together downstream of the separator members and before passage to the conversion components. The guide member is positioned to deflect at least the outer edges of at least one ply away from the path that it would otherwise follow if not guided over the guide member.

23 Claims, 6 Drawing Sheets

CUSHIONING CONVERSION MACHINE WITH GUIDE ROLLER, AND METHOD

This invention relates generally as indicated to a cushioning (dunnage) conversion machine and, more particularly, to a paper feed arrangement for a cushioning conversion machine wherein multiple plies of sheet material, in particular paper, are converted into a relatively low density three-dimensional cushioning dunnage product.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Plastic packaging materials generally are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alternative. Paper is biodegradable, recyclable and composed of a renewable resource, making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4026,198; 4,085,662; 4,109,040; 4,237,776; 4,557,716; 4,650,456; 4,717,613; 4,750,896; and 4,968,291. These cushioning conversion machines convert sheet stock material, such as paper in multi-ply form, into relatively low density cushioning pads.

A cushioning conversion machine of the general type disclosed in the aforesaid patents typically includes a stock supply assembly, a forming assembly, a feeding/connecting assembly, and a severing assembly. During operation of the cushioning conversion machine, the stock supply assembly supplies multi-ply sheet stock material to the forming assembly. The forming assembly causes inward rolling or folding of the lateral edges of the sheet stock material to form a continuous strip having lateral pillow-like portions and a thin is central band. The feeding/connecting assembly, in the form of a gear assembly, pulls the stock material through the forming assembly and also connects, as by coining, the central band of the continuous strip to form a connected or coined strip of cushioning. The strip of cushioning travels downstream to the severing assembly which cuts or otherwise severs the strip into pads of a desired length.

In machines of the above-described type, the stock supply assembly typically includes a feed apparatus or arrangement comprising a support for a roll of paper stock in multi-ply form, a "constant entry point" roller (i.e., a roller that serves as a single point of entry to the paper feed apparatus for all the paper plies) over which pass multiple plies of paper from the stock supply roll; and a plurality of separator members in the form of bars or rollers that are interleaved between the plies of paper passing from the constant entry point roller to the forming assembly, so that each separator bar or roller can support or guide an individual ply of paper. The plies are fed one above the other through a grille defined by the separator bars that are arranged in a spaced relationship transverse to the generally planar extent of the plies passing thereby. The thus-separated plies of paper pass forwardly into the forming assembly of the machine for forming into the dunnage product.

Although the multiple plies (typically two or three in number) on the stock roll are separated from one another by the separator bars, they all pass, albeit at mutually spaced locations, into the same forming assembly of the conversion machine for forming into dunnage. Thus, the respective plies travel different distances through the dunnage conversion apparatus, by virtue of the presence of the separator bars. This causes the plies to become crumpled independently of one another in the forming assembly and this enhances the padding and shock absorbing characteristics of the thus-formed dunnage, while minimizing the quantity of supply paper required to create a given length of dunnage.

A problem has been encountered particularly in vertically oriented machines of the type described in U.S. patent application No. 08/486,811 (published as PCT Application No. PCT/US 95/09274). As the multi-ply stock material unwinds from the stock roll for conversion by the machine into a cushioning product, the inner ply of the roll becomes increasingly slack and "bags". If this slack or "bag" is pulled into the machine all at once, it can negatively impact on the integrity or quality of the cushioning product and can cause the web of stock material to tear and/or jam the machine. The problem becomes more severe when three-ply, as opposed to two-ply, paper is used.

SUMMARY OF THE INVENTION

The present invention provides a solution to the aforesaid problem. In a broad sense, the invention solves the problem by readjusting the relative tension acting on the plies of the stock roll, as by providing a novel paper feed arrangement which adjusts the tension on the plies to reduce the tendency of the inner ply to form a "bag" consisting of a slack portion or loop of the inner ply. Preferably this is accomplished by causing the edges of all of the plies to traverse a common path downstream of ply separator members before any significant inward rolling or folding of the plies occurs.

In a preferred embodiment of cushioning conversion machine, a guide member is interposed between the separator members and the forming assembly to adjust the relative tension acting on the plies of the stock material.

The guide member is positioned to deflect one or more of the plies, at least at the outer edges thereof, away from the path that such plies would otherwise follow if the respective plies were not guided over the guide member. More preferably, all of the plies are deflected by the guide member at a location between the separator members and forming assembly.

More particularly, a preferred embodiment of a cushioning conversion machine, which converts a multi-ply sheet stock material into a cushioning product, comprises:

- a forming assembly which forms the stock material into a continuous three-dimensional strip of cushioning;
- a feeding assembly which pulls the stock material through the forming assembly under tension; and
- a stock supply assembly which supplies the stock material from a roll thereof to said forming assembly, said stock supply assembly including:

a constant entry member over which the multi-ply sheet stock material is passed under tension;

a plurality of laterally extending separator members for separating the plies of the sheet stock material from one another, the separator members being arranged in a spaced relationship transverse to the generally planar extent of the plies passing from the constant entry member to the forming assembly; and a laterally extending guide member positioned between the separator members and the forming assembly for deflecting at least the outer edges of at least one ply of the stock roll, in a direction transverse to the generally planar extent of the ply, from the path that the outer edges of the ply would otherwise follow if not guided over the guide member. This varies the relative lengths of the paths of the outer edges of the plies in such a manner that the formation of slack in the inner ply upstream of the forming assembly is minimized if not eliminated. Preferably, all of the plies are deflected at the outer edges thereof by the guide member thereby to cause the outer edges of the plies to travel along essentially the same path at a location downstream of the separator members and upstream of the forming assembly prior to any significant inward turning or folding of the plies.

According to another and preferred aspect of the invention, there is provided a method of converting a multi-ply sheet stock material into a cushioning product, comprising the steps of:

supplying the stock material from a supply thereof to a conversion assembly; and using the conversion assembly to convert the stock material into a continuous three-dimensional strip of cushioning; and wherein said supplying step includes:

passing the multi-ply stock material over a constant entry member;

passing the individual plies over respective laterally extending separator members between the constant entry member and the conversion assembly to separate at least two of the plies of the sheet stock material from one another, the separator members being arranged in a spaced relationship transverse to the generally planar extent of the plies passing from the constant entry member to the conversion assembly; and passing at least the outer edges of at least one ply of the stock roll over a laterally extending guide member between the separator members and the conversion assembly such that the path of the outer edges of the ply is deflected, in a direction transverse to the generally planar extent of the ply, from the path that the outer edges of the ply would otherwise follow if the ply was not guided over the guide member.

According to still another preferred aspect of the invention, a cushioning conversion machine which converts a multi-ply sheet stock material into a cushioning product, comprises a conversion assembly which crumples and shapes the stock material into a continuous three-dimensional strip of cushioning; and a stock material feed arrangement which first separates at least two of the plies of a stock roll from one another and then brings them back together at least at the edges thereof before passage to the conversion assembly.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

DETAILED DESCRIPTION OF THE INVENTION

Figure 1:
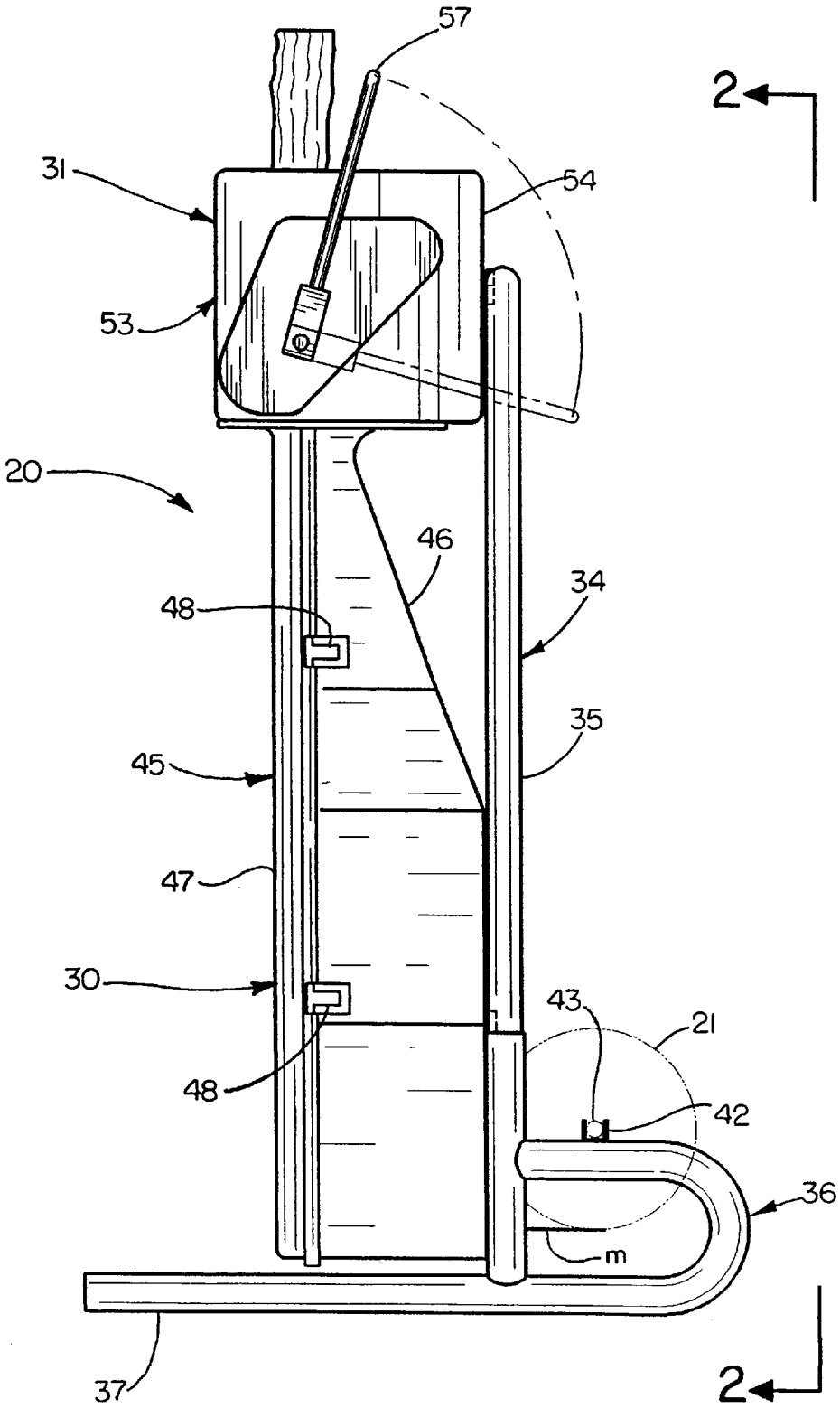
FIG. 1 is a side elevational view of a preferred embodiment of cushioning conversion machine according to the invention, the machine including front and rear units supported by a stand in a vertical orientation.
Figure 2:
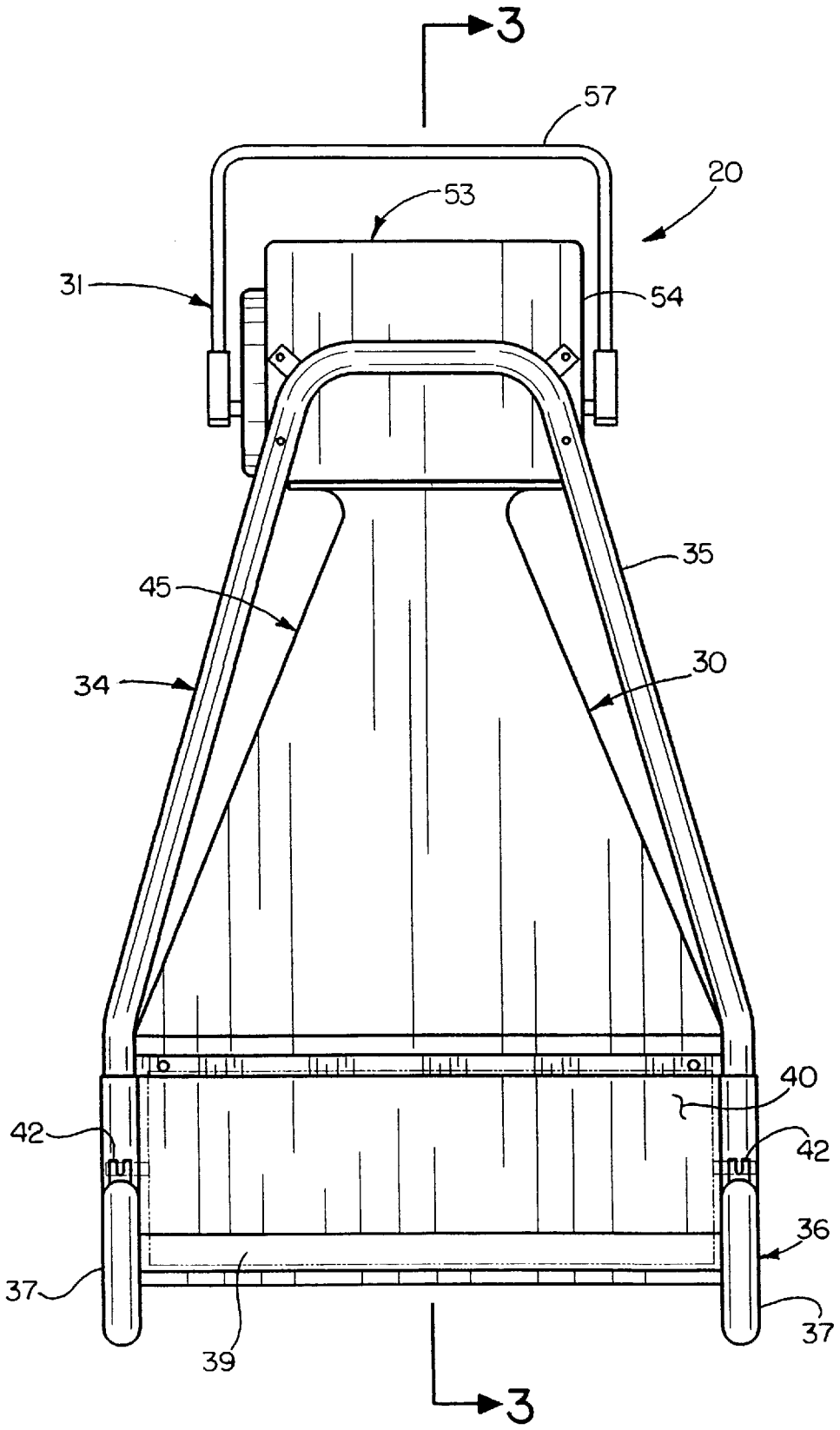
FIG. 2 is another elevational view of the conversion machine of FIG. 1, looking from the line 2—2 of FIG. 1.

Referring now to the drawings in detail, and initially to FIGS. 1 and 2, a cushioning conversion machine according to the present invention is generally indicated by reference numeral 20. The machine 20 is shown loaded with a roll 21 of sheet stock material M in FIG. 1. The stock material M preferably consists of a web of two or three superimposed plies or layers of biodegradable and recyclable paper and preferably Kraft paper, such as 30 to 50 pound Kraft paper, rolled onto a hollow cylindrical tube. The machine 20 converts the stock material into a continuous connected strip of relatively low density cushioning dunnage product having, for example, lateral pillow-like portions separated by a thin central band. This preferred form of strip is cut into sections, or pads, of a desired length for use as a protective packaging material.

The illustrated machine 20 is of a modular construction including a rear or upstream module, section or unit 30 and a front or downstream module, section or unit 31. The references to forward and rear are arbitrary, but are used to facilitate a description of the relative relationship of the components of the machine. The rear unit 30 and front unit 31 also are referred to as the shaping unit and the feed/cutting unit, respectively, in view of the functions associated therewith. The rear unit 30 and front unit 31 are also herein referred to as the former and head.

The references herein to downstream and upstream are made in relation to the movement direction of the stock material M through the machine 20. It will also be appreciated that references to top and bottom, upper and lower, etc. are made in relation to an illustrated orientation of the machine to describe positional relationships between components of the machine and not by way of limitation, unless so indicated.

The rear and front units 30 and 31 are supported in a vertical orientation by securement to an upright support stand 34. The stand 34 comprises an upper upright portion 35 and a bottom base portion 36 formed by a pair of feet 37 configured for stable support atop a horizontal surface such as a floor surface. As shown in FIG. 2, the rear unit has an entry opening 39 in the base wall 40 thereof for passage of stock material into the interior of the rear unit. Each foot 37 includes a respective one of a pair of cradles 42 for receiving the ends of a stock roller holder, for example an axle 43. If desired, each foot may be equipped with wheels such as casters for rolling on a floor.

The rear unit 30 has a housing in the form of an outer or external shell 45. The shell 45 has a base 46 and a cover 47. The cover 47 is removably fastened to the base by one or more latches 48 for easy opening and closing. The cover may be opened and closed to gain access to the interior of the shell which, in FIGS. 1 and 2, blocks from view interior components of the rear unit.

The front unit 31 has a housing 53 including an outer or external shell 54 and a frame which is hidden from view in FIGS. 1 and 2 by the shell 54 along with other internal components of the front unit. As shown in FIGS. 1 and 2, the front unit has an operator lever or handle member 57 which is used to control operation of the machine 20, i.e., feeding of the stock material M through themachine and cutting off sections of the dunnage product.

Figure 3:
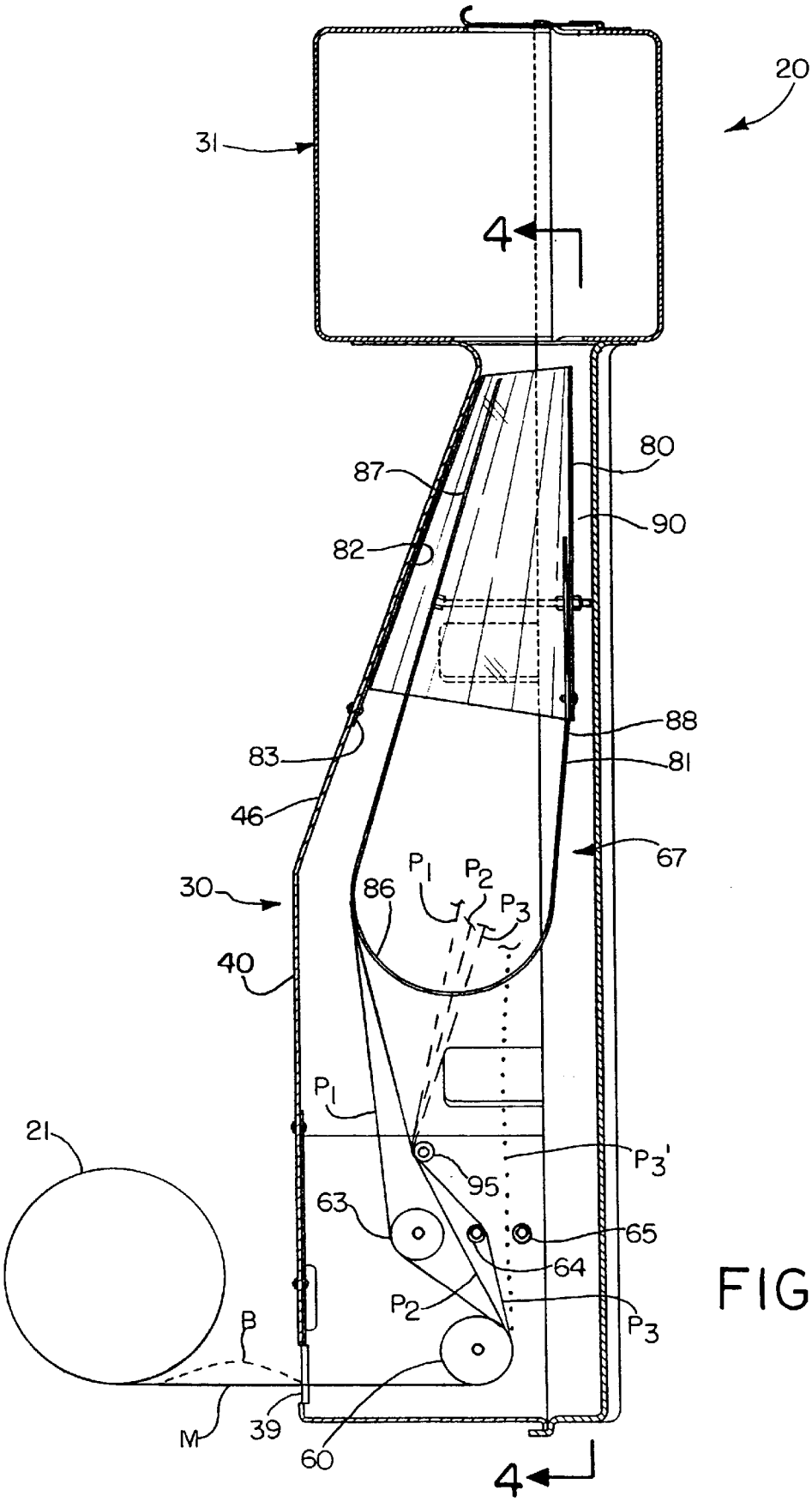
FIG. 3 is a longitudinal sectional view of the conversion machine of FIG. 1 separate from the stand and taken substantially along the line 3—3 of FIG. 2.
Figure 4:
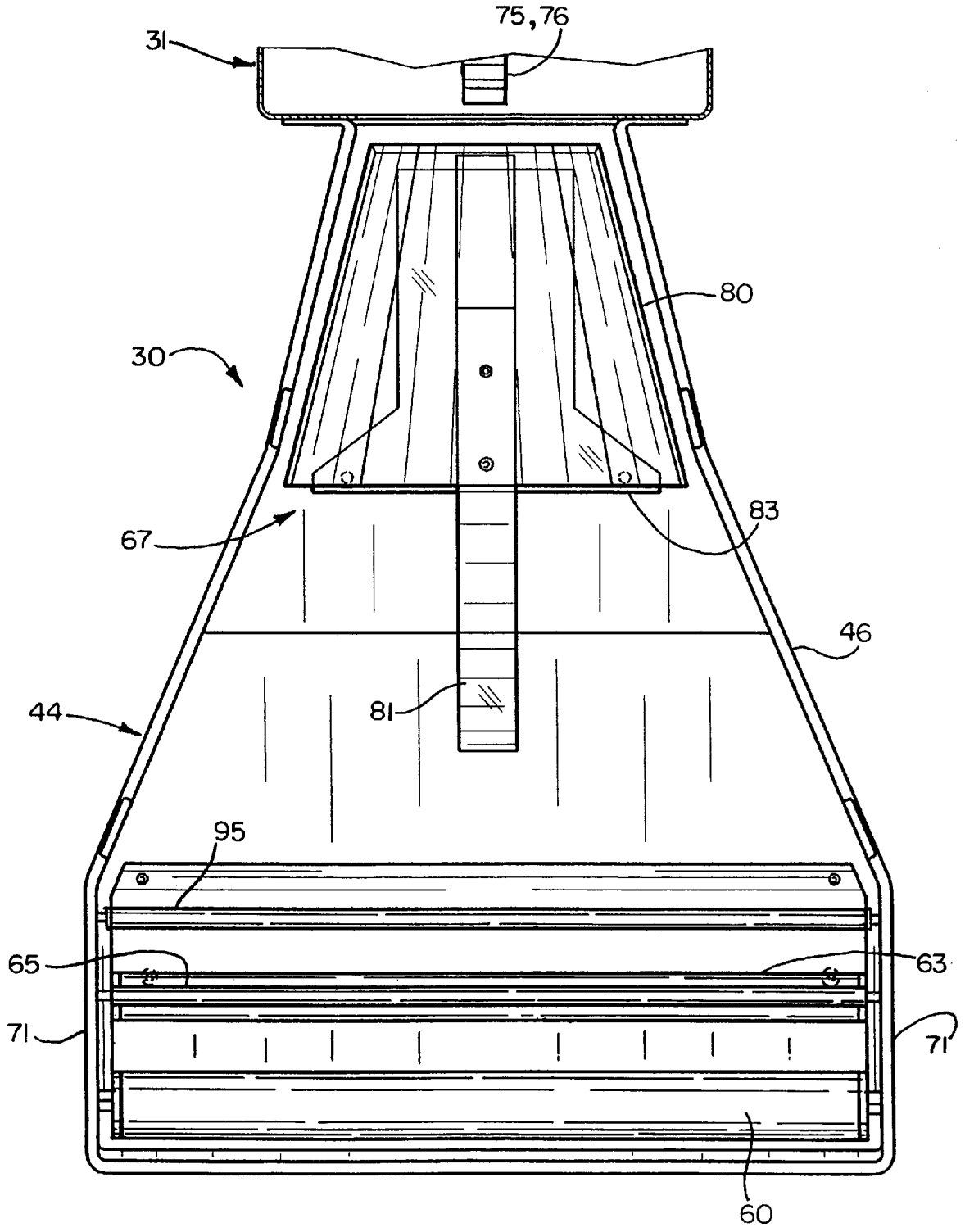
FIG. 4 is a longitudinal sectional view taken substantially along the line 4—4 of FIG. 3.

In FIGS. 3 and 4, pertinent interior components of the rear and front units 30 and 31 are shown. As seen at the bottom in FIGS. 3 and 4, the rear unit 30 includes an entry guide preferably in the form of an entry roller 60 that provides a non-varying point of entry for the sheet stock material M from the stock roll 21. The stock material passes from the stock roll through the inlet opening 39 in the bottom wall 40 of the shell base 46. From the constant entry roller 60, the individual plies $P_1$–$P_3$ of the stock material pass over laterally extending separator members, preferably rollers 63–65, which separate the multiple plies $P_{1-P3}$ of the stock material from one another prior to passing into a forming assembly 67. It is noted that in relation to the path of the stock material over the entry roller 60, the inner ply $P_1$ is the ply radially closest the entry roller and the outer ply $P_3$ is the radially outermost ply. It also is noted that in the illustrated machine, the inner ply $P_1$, the middle ply $P_2$ and the outer ply $P_3$ respectively form the outer, middle and inner layers of the strip of cushioning formed by the machine.

FIG. 4 shows how the entry roller 60 and separator rollers 63–65 are supported by and extend laterally between the side walls 71 of the base 46 or more generally the shell 44, whereupon the shell functions as an external frame for the entry and separator rollers. The rollers may be of any suitable type; for example, the rollers may include outer roller sleeves which rotate on shafts extending therethrough, with the ends of the shafts secured to the side walls of the shell. The inner ply separator roller 63 preferably is of greater diameter than the other two rollers 64 and 65.

The front unit 31 houses a feeding/connecting mechanism and a severing mechanism that are omitted from the view for the most part, as the specific form of these mechanisms can be selected as desired. For details of exemplary feeding/connecting mechanisms and severing mechanisms, as well as other known features of the illustrated machine and its known method of operation, reference may be had to U.S. patent application Ser. No. 08/486,811 (published as PCT Application No. PCT/US 95/09274), which is hereby incorporated herein by reference in its entirety. However, it is here noted that the feeding/connecting mechanism comprises rotatable, generally loosely meshed gear-like members 75, 76 which are adapted to coin the stock material along a central band to stitch the stock material together thereby to maintain the three-dimensional shape of the strip of cushioning. The rotating gear-like members engage and move the product through the machine, pulling the stock material off of the stock roll, past the ply separator rollers, and through the forming assembly. An electric motor and speed reducer preferably are utilized to drive one of the gear-like members which, because of the generally meshed relation between the gear-like members, drives the other gear-like member. The gear-like members may, for example, be of the type described in commonly assigned U.S. Pat. No. 4,968,291.

As seen in FIGS. 3 and 4, the forming assembly 67 comprises a longitudinally converging member or chute 80 and a forming member 81. The shaping chute 80 has secured to the base wall 82 thereof a mounting plate 83 which has a widened rear end portion which extends axially to the rear of the chute for convenient attachment to the sloped bottom wall portion of the rear unit's shell base wall 40. As the sheet material is passed through the shaping chute 80, the side edges of the plies are rolled or folded inwardly into a generally spiral form and further are crumpled to varying degrees to produce resilient pillow-like portions of stock material disposed in lateral abutting relationship as the folded and crumpled plies emerge from the exit end of the shaping chute. The forming member 81 coacts with the shaping chute to ensure proper shaping, forming and guiding of the paper, the forming member being operative to guide the central portion of the stock material along the bottom wall 82 of the shaping chute for controlled inward rolling of the side edge portions of the stock material. The forming member also extends into the shaping chute with its forwardmost end disposed relatively close to the underlying bottom wall of the shaping chute adjacent the exit end of the shaping chute.

The forming member 81 preferably has a pinched U-shape that generally corresponds in appearance to a bobby pin as shown. The upstream end or bight portion 86 of the forming member is rounded and preferably of semi-circular shape. The forming member preferably is made of a suitable material such as plastic which has sufficient flexibility such that the rounded bight portion 86 of the forming member functions as a living hinge permitting adjustment of its guide leg 87 towards and away from the bottom wall 82 of the shaping chute 80.

The legs 87 and 88 of the U-shape forming member 81 are generally straight and converge towards one another to give the U its pinched U or bobby pin shape. The mounting leg 88 is attached to the top wall 90 of the shaping chute along the center plane thereof by suitable fastening means. The upper leg may be bent, for example, at the exit end of the shaping chute to shift the bight portion 86 of the U downwardly to provide a desired gap between the rearward end of the forming member and the bottom wall of the shell base for proper guiding of the separated plies of sheet material into the entry end of the shaping chute.

The guide leg 87 of the forming member 81 extends generally parallel to the bottom wall 82 of the shaping chute 80. However, the relative inclination and spacing between the guide leg of the forming member and bottom wall of the shaping chute may be adjusted as needed to obtain proper shaping and forming of the lateral edges of the stock material into the relatively low density pillow like portions with the inner edges being overlapped for connection by the coining gears 75, 76 of the feeding or pulling mechanism in the front unit 31. As is preferred, the guide leg 87 of the forming member extends to a point approximately coterminous with the exit end of the shaping chute 80. The rearward portion of the forming member preferably projects rearwardly of the entry end of the shaping chute by approximately one-half its overall length. Also, the radius of the rounded base or bight portion 86 of the forming member preferably is approximately one-half the height of the mouth of the shaping chute. This provides for a smooth transition from the separator members of the separating device to the forming member and then into the shaping chute.

The forming member 81 is of relatively uniform width. The forming member may be formed, for example, by bending an elongate elastic strip to the shape illustrated in FIG. 3. In the illustrated embodiment, the width of the strip is approximately one quarter the width of the exit opening of the shaping chute 80 which in turn is approximately two-thirds of the entry mouth of the shaping chute. The forming member may be otherwise configured. For example, the rearward end portion may be wider than the forward end portion. Moreover, the transition from the narrow forward portion to the wide rear end portion may be progressive such that the guide leg of the forming member has a triangular shape. Similarly, the mounting leg 88 may have a triangular shape while the rounded bight portion 86 of the forming member may be relatively uniform in width or of reverse hour-glass shape.

The machine 20 as thus far described is well known in the art as is its method of operation. During operation, the multiple plies $P_1$–$P_3$ (typically two or three in number) on the stock roll are, as shown in FIG. 3, separated from one another by the separator bars 63–65 and all pass, albeit at mutually spaced locations, into the forming assembly 67 for forming into dunnage. Thus, the respective plies, or at least portions thereof, travel different distances through the dunnage conversion apparatus, by virtue of the presence of the separator bars. This causes the plies to become crumpled independently of one another in the forming assembly and this enhances the padding and shock absorbing characteristics of the thus-formed dunnage, while minimizing the quantity of supply paper required to create a given length of dunnage.

As above mentioned, a problem has been encountered particularly when the machine is vertically oriented as shown in FIG. 3. As the multi-ply stock material unwinds from the stock roll for conversion by the machine into a cushioning product, the inner ply $P_1$ of the stock roll becomes increasingly slack and "bags"(forms a pucker or loop between the stock roll and the constant entry roller as depicted in phantom lines in FIG. 3 at B). If this slack or "bag" is pulled into the machine all at once, it can negatively impact on the integrity or quality of the cushioning product and can cause the web of stock material to tear and/or jam the machine. The problem becomes more severe when three-ply, as opposed to two-ply, paper is used.

The present invention provides a solution to the aforesaid problem. It has been discovered that the problem can be solved by readjusting the paper paths and thus the relative tension acting on the plies of the stock roll, as by providing a novel paper feed arrangement which reduces the tendency of the inner ply to form a "bag".

In the preferred embodiment of cushioning conversion machine shown in FIGS. 3 and 4, a laterally extending guide member 95 is interposed between the separator members (particularly the inner ply separator member 63) and the forming assembly 67. Like the entry roller 60 and separator rollers 63–65, the guide member preferably extends the full width of the plies of the stock material and is supported by and extends between the side walls 71 of the base 46 or more generally the shell 44 as seen in FIG. 4, preferably in parallel relationship with the entry roller and separator rollers. The guide member may be a rod or a roller of any suitable type; for example, the guide member 95 may include an outer roller sleeve which rotates on a rod or shaft extending therethrough, with the ends of the shaft secured to the side walls of the shell. The guide roller may be of the same diameter as the two separator rollers 64 and 65.

The guide member 95 is positioned to deflect at least the outer edges of at least one of the plies of the stock roll, preferably the middle and outer plies, and more preferably the inner, middle and outer plies, away from the path that the ply or plies would otherwise follow if not guided over the guide member. In the illustrated embodiment, the guide member has the center thereof spaced about 6.35 cm (2.5 inches) downstream of the separator roller 63 (approximately one third the distance between the separator members 63–65 and the upstream end of the forming assembly) and about 1.25 cm (0.5 inch) in the direction of the separator rollers 64 and 65 from a plane that extends perpendicular to the transverse plane of the grille formed by the separator members 63–65 and which intersects the axis of the inner ply separator roller 63. This positions the guide member such that it will effect a deflection of the outer edges of the outer ply $P_3$ of about 3.5 cm (about 1.4 inch) from the path the outer edges would otherwise have traveled if the guide member was not there, such path of the outer edges being indicated by a dotted line and denoted $P_3'$. The resultant increase in the length of the outer edges of particularly the outer and middle plies $P_2$ and $P_3$ imparts additional tension to these plies, thereby reducing and thus equalizing their consumption relative to the inner ply $P_1$ which is at least deflected at its outer edges by the guide member. This minimizes the formation of slack in the inner ply upstream of the constant entry roller. Moreover, the outer edges of all of the plies are brought together downstream of the separator members and upstream of the forming assembly, preferably prior to any significant inward rolling or folding of the plies.

Thus, in accordance with the preferred method of the invention, the plies $P_1$–$P_3$ of the stock roll are threaded into and through the machine as illustrated in FIG. 3. All of the plies are commonly passed over the constant entry roller 60. The individual plies then pass over respective separator members 63–65 between the constant entry member and the forming assembly 67 such that the separator members are interleaved with the plies to separate the plies of the sheet stock material from one another. It is noted that the separator members are arranged in a spaced relationship transverse to the generally planar extent of the plies passing from the constant entry member to the forming assembly.

The plies $P_1$–$P_3$ then pass from the separator members 63–65 underneath the guide member 95 such that the path of the outer edges of the plies, and particularly the middle ply $P_2$ and outer ply $P_3$, are deflected, in a direction transverse to their generally planar extent, from the path that the plies would otherwise follow if not guided over the guide member. Moreover, the edges of all of the plies are deflected by the guide member and thus brought together downstream of the separator members and prior to inward rolling or folding of the plies as they move to the forming assembly. Such rolling of the edge portions of the plies essentially commences immediately upon the plies moving past (downstream of) the guide roller. It has been found that particularly with use of the guide member 95, the outermost separator member 65 has minimal contact with the outer ply and thus is optional and may be eliminated if desired. In FIG. 3, the paths of the centers of the plies $P_1$–$P_3$ is shown in solid lines while the paths of the outer edges of the plies is shown in broken lines. During initial loading, the plies are threaded over the constant entry roller, separator members and guide member, and then preferably brought together and the leading corners folded over to form a triangular leading end of the stock material. This facilitates insertion of the leading end of the stock material into and through the forming assembly for positioning of the pointed end for engagement by the pulling assembly in a well known manner.

Figure 5:
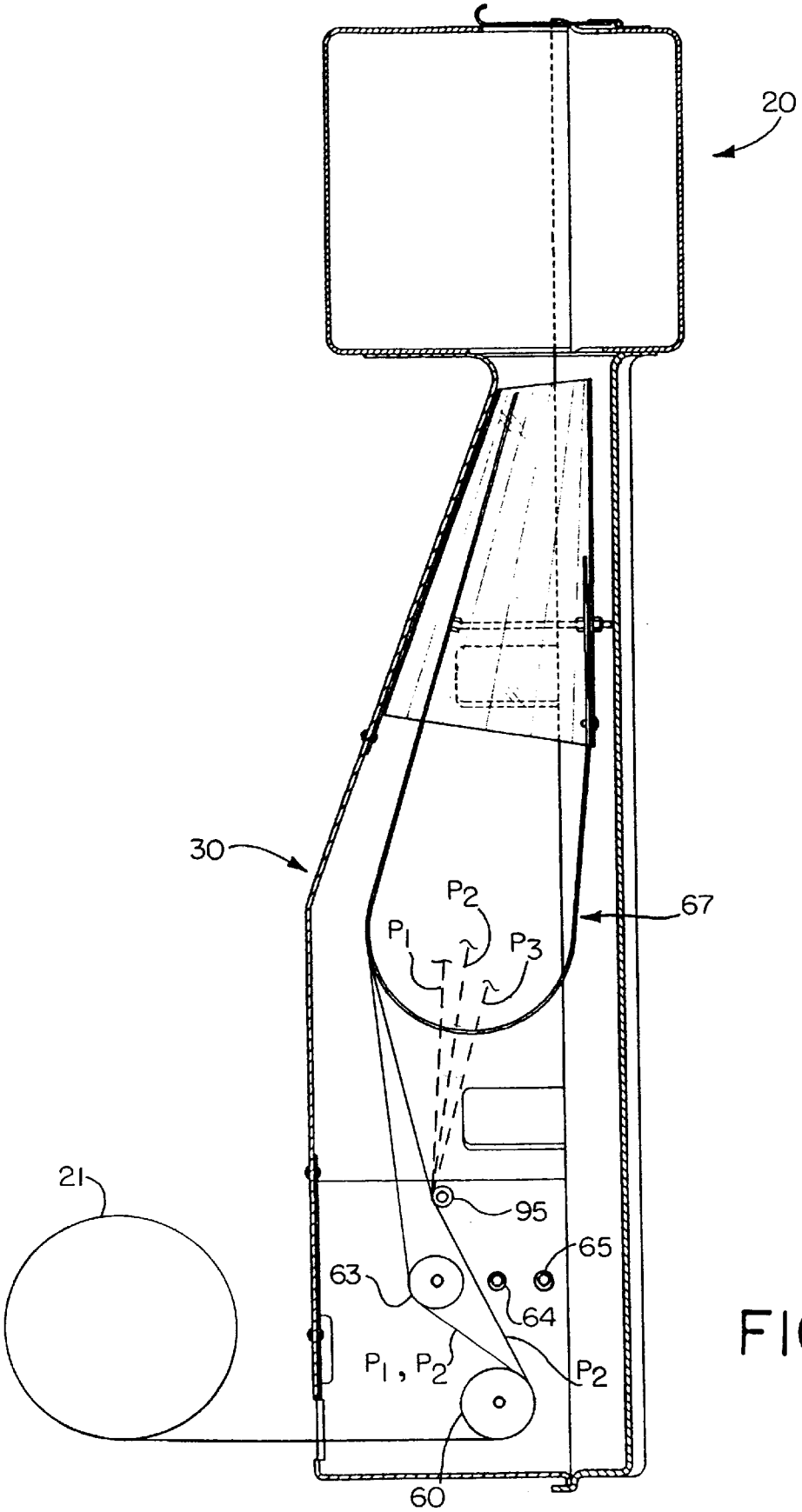
FIG. 5 is a view similar to FIG. 3, showing an alternative threading arrangement for a three ply stock roll.

FIG. 5 shows an alternative ply threading arrangement or pattern for three ply stock material. In this arrangement, all of the plies are commonly passed over the constant entry roller 60. The outer ply then passes between the separator members 63 and 64 (or optionally between the separator members 64 and 65) while the middle and inner plies commonly pass over the underside of the separator member 63. The plies $P_1$–$P_3$ then pass from the separator rollers underneath the guide member 95 such that the path of the outer edges of the plies are deflected in a direction transverse to the generally planar extent of the plies passing thereover, from the path that the outer edges of the plies would otherwise follow if the plies was not guided over the guide member.

Figure 6:
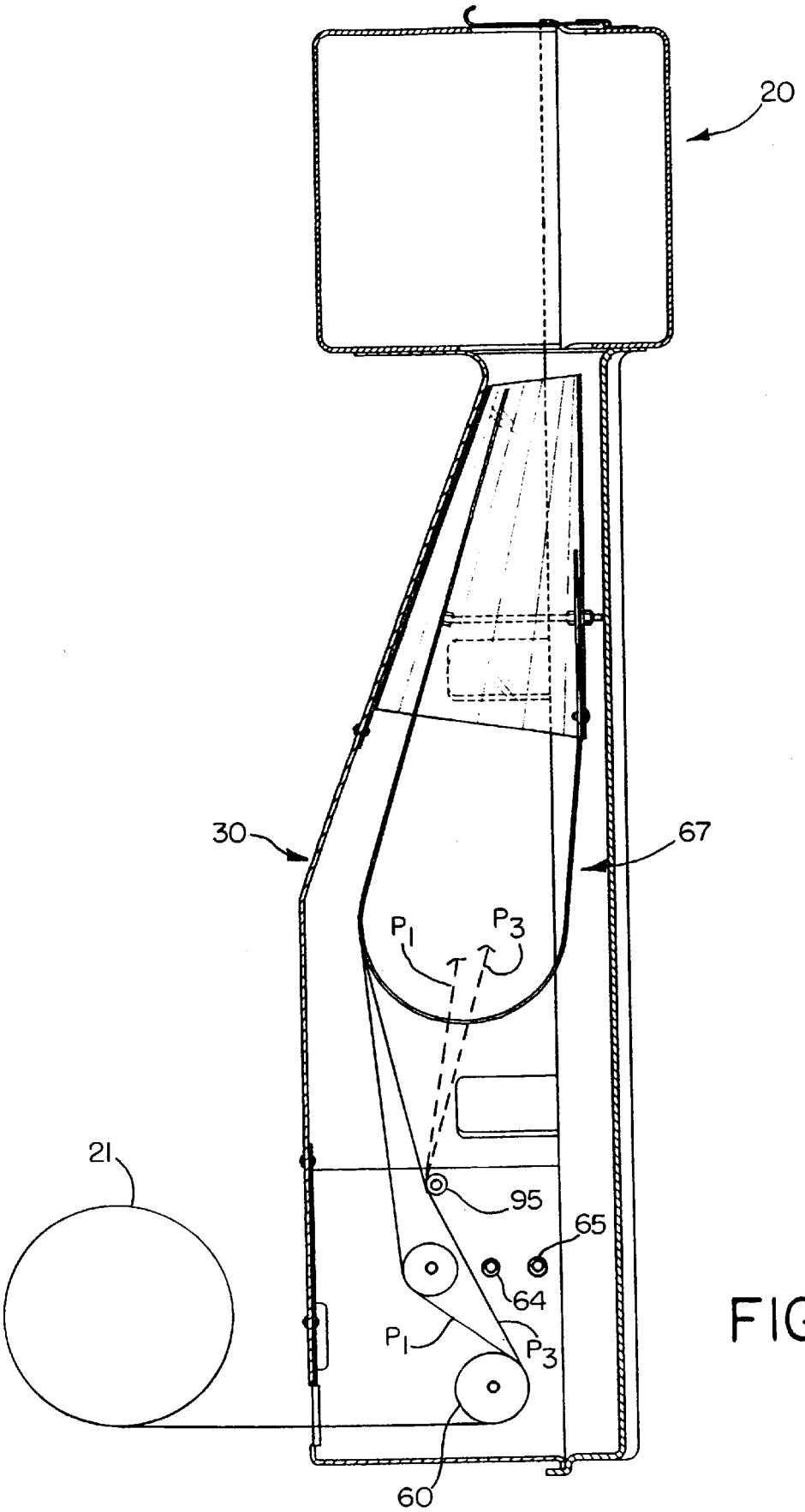
FIG. 6 is a view similar to FIG. 3, showing a threading arrangement for a two ply stock roll.

FIG. 6 shows a ply threading arrangement or pattern for two ply stock material. This arrangement is the same as the inner and middle plies of the threading pattern shown in FIG. 3. Both plies of the stock material are commonly passed over the constant entry roller 60. The outer ply then passes between the separator members 63 and 64 (or optionally between the separator members 64 and 65) while the inner ply passes over the underside of the separator member 63. The plies $P_1$ and $P_2$ then pass from the separator rollers underneath the guide member 95 such that the paths of the outer edges of the plies are deflected in a direction transverse to the generally planar extent of the plies passing thereover, from the path that the outer edges of the plies would otherwise follow if the plies was not guided over the guide member.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A method of converting a multi-ply sheet stock material into a cushioning product, comprising the steps of:

supplying the stock material from a roll thereof to a conversion assembly; and using the conversion assembly to convert the stock material into a continuous three-dimensional strip of cushioning; and wherein said supplying step includes:

passing the multi-ply stock material over a constant entry member;

passing the individual plies over respective laterally extending separator members between the constant entry member and the conversion assembly to separate at least two of the plies of the sheet stock material from one another, the separator members being arranged in a spaced relationship transverse to the generally planar extent of the plies passing from the constant entry member to the conversion assembly; and passing at least the outer edges of at least one ply of the stock roll over a laterally extending guide member between the separator members and the conversion assembly such that the path of the outer edges of the ply is deflected, in a direction transverse to the generally planar extent thereof, from the path that the ply would otherwise follow if not guided over the guide member.

2. A method as set forth in claim 1 wherein said supplying step comprises supplying stock material that is biodegradable and recyclable.

3. A method as set forth in claim 2 wherein said supplying step comprises supplying stock material that is Kraft paper.

4. A method as set forth in claim 1 wherein said three dimensional strip of cushioning includes lateral pillow-like portions separated by a central band.

5. A method as set forth in claim 4 wherein the central band is coined.

6. A method as set forth in claim 1 further comprising the steps of cutting the strip of cushioning into sections of a desired length.

7. A method as set forth in claim 1 wherein the conversion assembly is part of cushioning conversion machine comprising a housing which at least partially encloses the conversion assembly and wherein the constant entry roller is supported by and extends laterally between side walls of the housing.

8. A method as set forth in claim 7 wherein the separator members are supported by and extend laterally between side walls of the housing.

9. A method as set forth in claim 1 wherein the conversion assembly comprises a forming assembly which forms the stock material and a feed assembly which pulls the stock material through the forming assembly.

10. A method as set forth in claim 9 wherein the forming assembly comprises a shaping chute and a forming member which coacts with the shaping chute to ensure proper shaping, forming and guiding of the stock material.

11. A method as set forth in claim 10 wherein the forming member is operative to guide a central portion of the plies of stock material along a bottom wall of the shaping chute for controlled inward rolling of outer edges of the plies of stock material.

12. A method as set forth in claim 1 wherein the stock material passes through the conversion assembly in a substantially vertical direction.

13. A method as set forth in claim 1 wherein the guide member extends the full width of the plies of stock material.

14. A method as set forth in claim 1 wherein the conversion assembly is part of a cushioning conversion machine comprising a housing at least partially enclosing the conversion assembly and wherein the guide member is supported by and extends between side walls of the housing.

15. A method as set forth in claim 14 wherein the guide member includes a roller sleeve and a shaft which extends through the roller sleeve, the ends of the shaft being secured to the housing side walls and the roller sleeve rotating around said shaft.

16. A method as set forth in claim 1 wherein the guide member is a roller.

17. A method as set forth in claim 1 wherein the separator members are separator rollers, wherein the guide member is a guide roller and wherein the guide roller is the same diameter as the separator rollers.

18. A method as set forth in claim 1 wherein the conversion assembly comprises a forming assembly which forms the stock material and a feed assembly which pulls the stock material through the forming assembly and wherein the guide member is positioned approximately one-third the distance between the separator members and an upstream end of the forming assembly.

19. A method as set forth in claim 18 wherein the forming assembly comprises a chute and a forming member which coacts with the chute to ensure proper shaping, forming and guiding of the stock material.

20. A method as set forth in claim 19 wherein the forming member is operative to guide a central portion of the plies of stock material along a bottom wall of the shaping chute for controlled inward rolling of outer edges of the plies of stock material.

21. A method as set forth in claim 1 wherein said passing steps include passing at least the outer edges of more than one ply of stock material over the laterally extending guide member.

22. A method as set forth in claim 21 wherein said passing steps include passing at least the outer edges of all of the plies of stock material over the laterally extending guide member.

23. A method as set forth in claim 1 wherein said passing steps cause outer edges of all of the plies to traverse a common path downstream of the separator members before any significant inward rolling or folding of the plies occurs.

* * * * *